US007204006B2

(12) United States Patent
Herrington et al.

(10) Patent No.: US 7,204,006 B2
(45) Date of Patent: Apr. 17, 2007

(54) END-STOP FOR ZIPPERED RESEALABLE CLOSURE

(75) Inventors: F. John Herrington, Bloomfield, NY (US); Bryon Hollenbeck, Horseheads, NY (US)

(73) Assignee: Webster Industries Division Chelsea Industries, Inc., Peabody, MA (US)

( * ) Notice: Subject to any disclaimer, the term of this patent is extended or adjusted under 35 U.S.C. 154(b) by 90 days.

(21) Appl. No.: 10/969,227

(22) Filed: Oct. 20, 2004

(65) Prior Publication Data

US 2005/0108861 A1 May 26, 2005

Related U.S. Application Data

(60) Provisional application No. 60/512,658, filed on Oct. 20, 2003.

(51) Int. Cl.
*B21D 53/52* (2006.01)
*A41H 37/06* (2006.01)

(52) U.S. Cl. ..... 29/409; 29/410; 29/33.2; 29/766; 29/767

(58) Field of Classification Search ..... 29/408, 29/409, 410, 33.2, 767, 766; 383/64, 65, 383/203, 61.2, 210.1; 24/436, 435, 387, 24/388

See application file for complete search history.

(56) References Cited

U.S. PATENT DOCUMENTS

| | | | | |
|---|---|---|---|---|
| 3,790,992 | A * | 2/1974 | Herz | 24/400 |
| 5,088,971 | A | 2/1992 | Herrington | 483/203 |
| 5,129,734 | A | 7/1992 | Van Erden | 383/61 |
| 5,161,286 | A | 11/1992 | Herrington, Jr. et al. | 24/387 |
| 5,405,478 | A | 4/1995 | Richardson et al. | 156/308.4 |
| 5,482,375 | A * | 1/1996 | Richardson et al. | 383/64 |
| 5,788,378 | A * | 8/1998 | Thomas | 383/63 |
| 5,833,791 | A * | 11/1998 | Bryniarski et al. | 156/244.25 |
| 6,569,368 | B2 | 5/2003 | Machacek | 264/155 |
| 6,662,410 | B2 | 12/2003 | Kolovich et al. | 24/399 |
| 6,846,107 | B2 | 1/2005 | Sweeney et al. | 383/64 |
| 6,871,473 | B1 * | 3/2005 | Dutt et al. | 53/133.4 |

* cited by examiner

*Primary Examiner*—Marc Jimenez
(74) *Attorney, Agent, or Firm*—Bromberg & Sunstein LLP

(57) ABSTRACT

A method for providing an end-stop for a slider on a resealable thermoplastic bag is provided. The resealable thermoplastic bag includes a profile track having a first side panel and a second side panel. A clip having first and second legs is made to straddle the profile track such that the first leg of the clip being proximate to the first side panel and the second leg of the clip being proximate to the second side panel. One of the legs has an inward-facing protrusion for engaging a corresponding recess on the panel proximate thereto, such that the clip resists vertical motion on the profile track. The other of the legs of the clip is sealed to the panel proximate thereto.

10 Claims, 8 Drawing Sheets

END-STOP FOR ZIPPERED RESEALABLE CLOSURE

The present application claims priority from U.S. Provisional Application No. 60/512,658, filed Oct. 20, 2003. The aforementioned provisional application is hereby incorporated herein by reference.

TECHNICAL FIELD

The present invention relates to resealable closure devices for storage containers and, in particular, to end-stops for resealable thermoplastic slider bags.

BACKGROUND ART

Resealable closure assemblies have become a fixture of the storage container industry. Thermoplastic bags, in particular, have gone through several stages of closure devices.

It is known in the prior art to provide plastic bags with mating profiles, so that a bag may be sealed by applying force with the fingers to cause the profiles to mate and unsealed by applying force with the fingers to cause the profiles to disengage.

Slider assemblies are also known for achieving sealing and unsealing of suitably fitted plastic bags. Use of a slider facilitates sealing and unsealing of such plastic bags. Slider assemblies include profile strips with male and female elements working in cooperation with a slider that straddles the top of the strips. The slider serves to join the male and female elements together when drawn in one direction, and to separate the profiles when drawn in the opposite direction. Generally, the elements are forced apart, one element at a time, by a separating finger on a top inside panel of the slider.

When a slider assembly is used to seal and unseal plastic bags, an end-stop may be provided to stop the slider from leaving the track. U.S. Pat. Nos. 5,131,121 and 5,088,971, both issued to Herrington et al., describe protruding end stops for a plastic reclosable fastener and methods for making such protruding end-stops. U.S. Pat. No. 5,161,286, also issued to Herrington et al., describes end clamp stops wherein two members of the end clamp are held together by a rivet. U.S. Pat. No. 5,405,478, issued to Richardson et al., describes tubular plastic end stops which are bonded to a plastic zipper. U.S. Pat. No. 5,924,173, issued to Dobreski et al. describes end terminations formed as posts with enlarged heads wherein the posts pass through the male and female tracks near the end region of a plastic zipper. All of these patents require that the end stop or clamps be sealed to both sides of the profile track, either through welding or riveting.

SUMMARY OF THE INVENTION

In a first embodiment of the invention there is provided a method for providing an end-stop for a slider on a resealable thermoplastic bag wherein the resealable thermoplastic bag includes a profile track, a first side panel and a second side panel. A clip having first and second legs is caused to straddle the profile track such that the first leg of the clip is proximate to the first side panel and the second leg of the clip is proximate to the second side panel. One of the legs has an inward-facing protrusion for engaging a corresponding recess on the panel proximate thereto such that the clip resists vertical motion on the profile track. The other of the legs of the clip is then sealed to the panel proximate thereto.

In accordance with a related embodiment, the clip may be substantially J-shaped. In accordance with other related embodiments, sealing the leg of the clip to the panel proximate thereto may include ultrasonically sealing the leg of the clip to the panel and/or ultrasonically sealing the leg of the clip to the panel proximate thereto may include smashing a portion of the profile track adjacent the clip. In accordance with a further related embodiment, one of the legs of the clip may be shorter than the other of the legs of the clip. In accordance with another related embodiment, sealing the other of the legs of the clip to the panel proximate thereto may include sealing an inward facing ridge thereof to the panel proximate thereto.

In accordance with another embodiment of the invention, a clip for providing an end-stop for a slider on a resealable thermoplastic bag is provided wherein the resealable thermoplastic bag includes a profile track having a first side panel and a second side panel. The clip includes first and second legs permitting the clip to straddle the profile track, in such a manner that the first leg of the clip is proximate to the first side panel and the second leg of the clip is proximate to the second side panel. One of the legs has an inward-facing protrusion for engaging a corresponding recess on the panel proximate thereto such that the clip resists vertical motion when the clip straddles the profile track. The other of the legs of the clip is longer than the leg having the protrusion and configured to permit being sealed to the panel proximate thereto. In accordance with a related embodiment, the longer leg of the clip may include an inward facing ridge for engaging the panel proximate thereto.

In accordance with a further embodiment of the invention, a method for making at least two resealable slider bags from a length of profile track is provided wherein the profile track is associated with a first side panel and a second side panel. A laterally indented portion is created at intervals along the profile track and a slider is inserted onto the profile track at each indented portion. Each slider is moved to a location away from the indented portion and clips, each having first and second legs, are caused to straddle the profile track proximate to each indented portion. The first leg of each clip is proximate to the first side panel and the second leg of each clip is proximate to the second side panel and one of the legs of each clip has an inward-facing protrusion for engaging a corresponding recess on the panel proximate thereto such that each clip resists vertical motion on the profile track. The other of the legs of each clip is sealed to the panel proximate thereto.

In accordance with are related embodiment, each clip may be substantially J-shaped. In accordance with other related embodiments, sealing the leg of each clip to the panel proximate thereto may include ultrasonically sealing the leg of each clip to the panel and/or ultrasonically sealing the leg of each clip to the panel proximate thereto may include smashing a portion of the profile track adjacent each clip. In accordance with a further related embodiment, one of the legs of each clip may beshorter than the other of the legs of the clip. In accordance with an additional related embodiment, sealing each leg of the clip to the panel proximate thereto may include sealing an inward facing ridge on the leg to the panel proximate thereto.

In accordance with another embodiment of the invention, a method for providing an end-stop for a slider on a resealable thermoplastic bag is provided wherein the resealable thermoplastic bag includes a profile track having a first side panel and a second side panel. A clip having first and second legs is caused to straddle the profile track such that the first leg of the clip is proximate to the first side panel and the second leg of the clip is proximate to the second side panel. One of the legs has an inward-facing protrusion for engaging a corresponding area on the panel proximate thereto such that the clip resists vertical motion on the profile track. The other of the legs of the clip is sealed to the panel proximate thereto.

In accordance with a related embodiment, the clip may substantially J-shaped. In accordance with other related embodiments, sealing the leg of the clip to the panel proximate thereto may include ultrasonically sealing the leg of the clip to the panel and/or ultrasonically sealing the leg of the clip to the panel proximate thereto may include smashing a portion of the profile track adjacent the clip. In accordance with further related embodiments, one of the legs of the clip may be shorter than the other of the legs of the clip and/or sealing the other of the legs of the clip to the panel proximate thereto includes sealing an inward facing ridge thereof to the panel proximate thereto.

In accordance with yet another embodiment of the invention, clip for providing an end-stop for a slider on a resealable thermoplastic bag is provided wherein the resealable thermoplastic bag includes a profile track having a first side panel and a second side panel. The clip includes first and second legs permitting the clip to straddle the profile track in such a manner that the first leg of the clip is proximate to the first side panel and the second leg of the clip is proximate to the second side panel. One of the legs has an inward-facing protrusion for engaging a corresponding area on the panel proximate thereto such that the clip resists vertical motion when the clip straddles the profile track. The other of the legs of the clip is longer than the leg having the protrusion and configured to permit being sealed to the panel proximate thereto. In accordance with a related embodiment, the longer leg of the clip may include an inward facing ridge for engaging the panel proximate thereto.

In accordance with a further embodiment of the invention, a method for making at least one resealable slider bag from a length of profile track is provided wherein the profile track is associated with a first side panel and a second side panel. A laterally indented portion is created on the profile track and a slider is inserted onto the profile track at the indented portion. The slider is moved to a location away from the indented portion and a clip having first and second legs is caused to straddle the profile track proximate to the indented portion such that the first leg of the clip is proximate to the first side panel and the second leg of the clip is proximate to the second side panel. One of the legs of the clip has an inward-facing protrusion for engaging a corresponding area on the panel proximate theretosuch that the clip resists vertical motion on the profile track. The other of the legs of the clip is sealed to the panel proximate thereto.

In accordance with a related embodiment, the clip may be substantially J-shaped. In accordance with other related embodiments, sealing the leg of the clip to the panel proximate thereto may include ultrasonically sealing the leg of the clip to the panel and/or ultrasonically sealing the leg of the clip to the panel proximate thereto may include smashing a portion of the profile track adjacent the clip. In accordance with further related embodiments, one of the legs of the clip may be shorter than the other of the legs of the clip and/or sealing the leg of the clip to the panel proximate thereto may include sealing an inward facing ridge on the leg to the panel proximate thereto.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1:
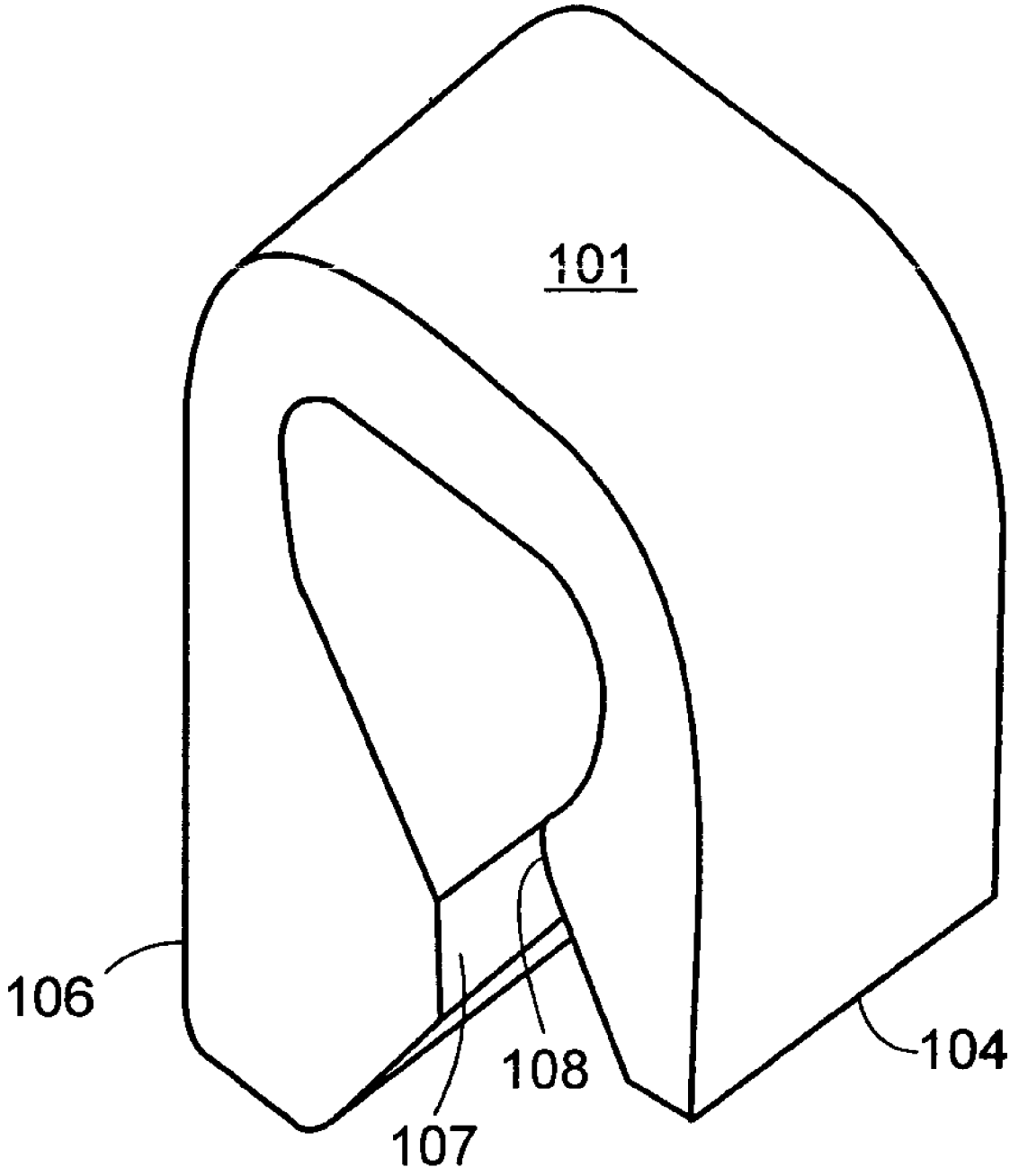
FIG. 1 is a perspective view of an end-clip configuration in accordance with an embodiment of the invention.
Figure 7:
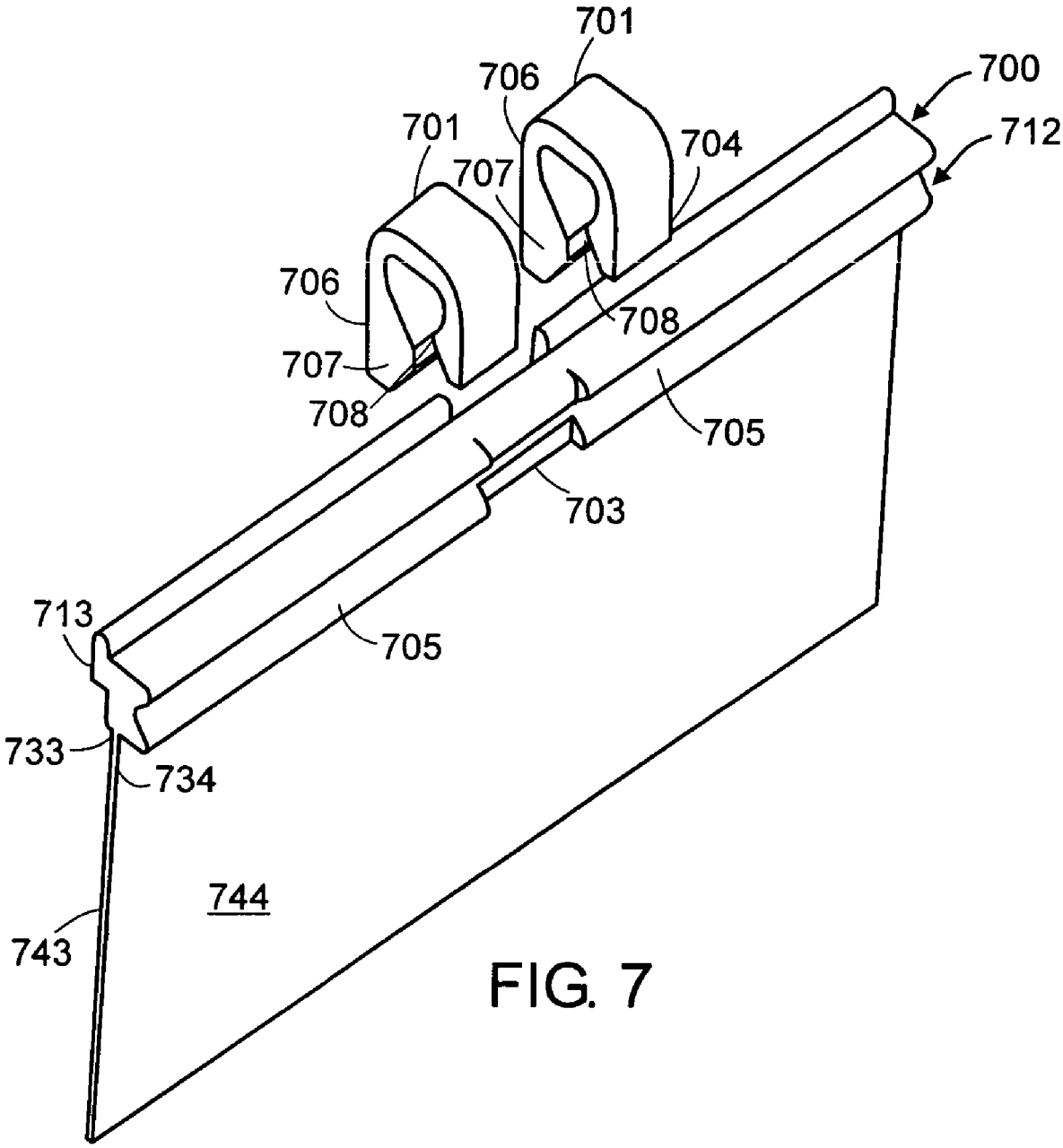
FIG. 7 is a perspective view showing use of two of the end-clips of FIG. 1 situated on a profile track in a process for forming a series of bags in accordance with a further embodiment of the invention.
Figure 8:
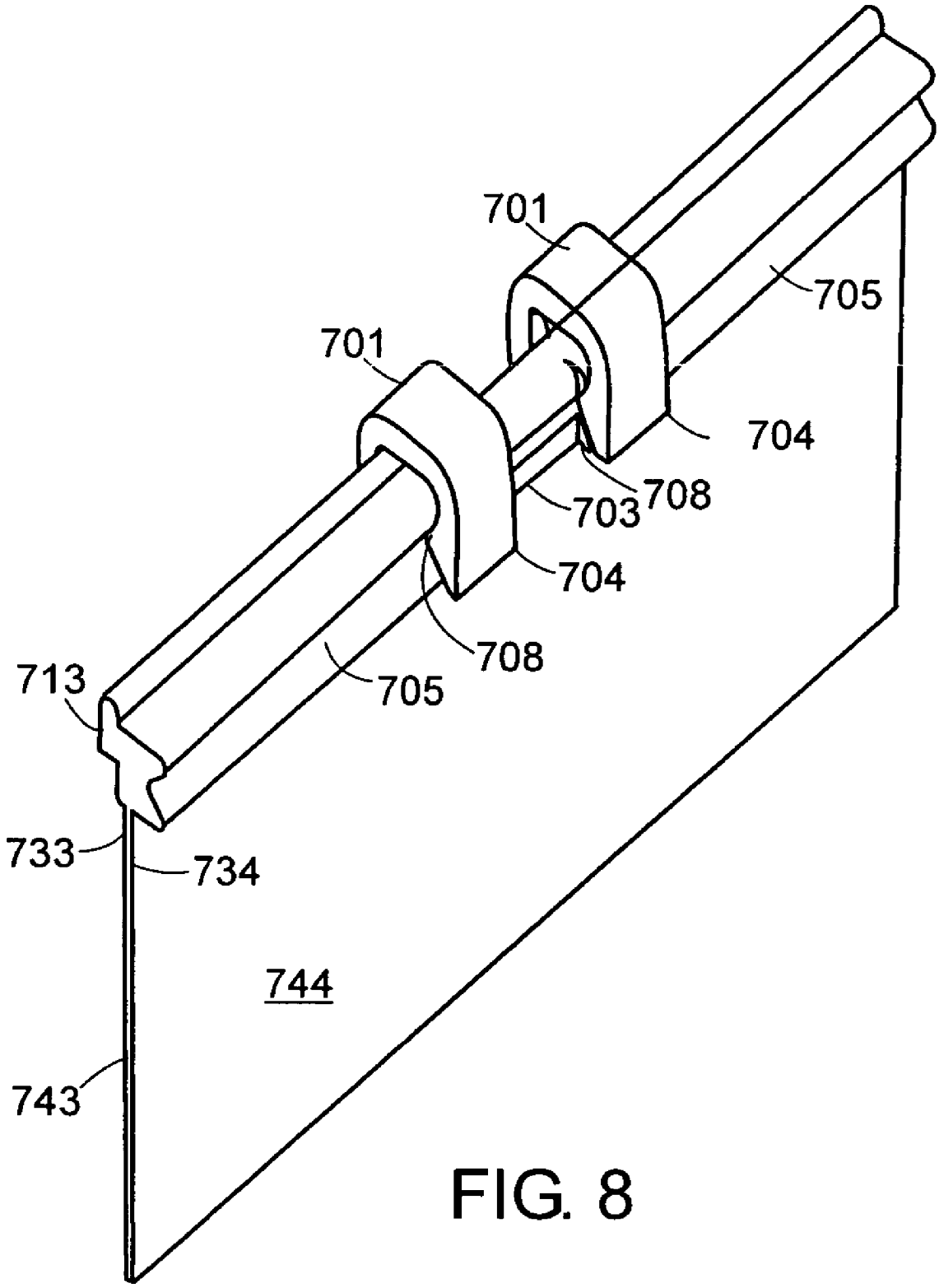
FIG. 8 is a perspective view showing the end-clips of FIG. 7 after being sealed to the profile track.

FIG. 1 is a perspective view of an end-clip configuration in accordance with an embodiment of the invention. The clip 101 of FIG. 1 provides an end-stop for a slider on a resealable thermoplastic bag (as shown in FIGS. 7 and 8). The clip 101 includes first and second legs, 104 and 106 respectively, which permit the clip 101 to straddle a profile track. At least one of the legs 104 has an inward-facing protrusion 108 for engaging a corresponding area on a panel of the bag or a corresponding fin of a profile track of the bag. In one embodiment, the corresponding area includes a recess (705 shown in FIG. 7) such that the protrusion 108 engages the recess 705 and the clip resists vertical motion when straddling the profile track . . . The leg 106 is configured to permit its being sealed to a second panel of the bag or a second fin of the profile track. Alternatively, the leg 106 of the clip 101 may include an inward facing ridge 107 which engages the second panel or fin, and only the ridge 107 may be sealed to the panel (as opposed to a greater portion of the leg 106). In accordance with the embodiment shown in FIG. 1, the clip 101 may be substantially J-shaped such that one leg 104 is shorter than the other leg 106.

Figure 2:
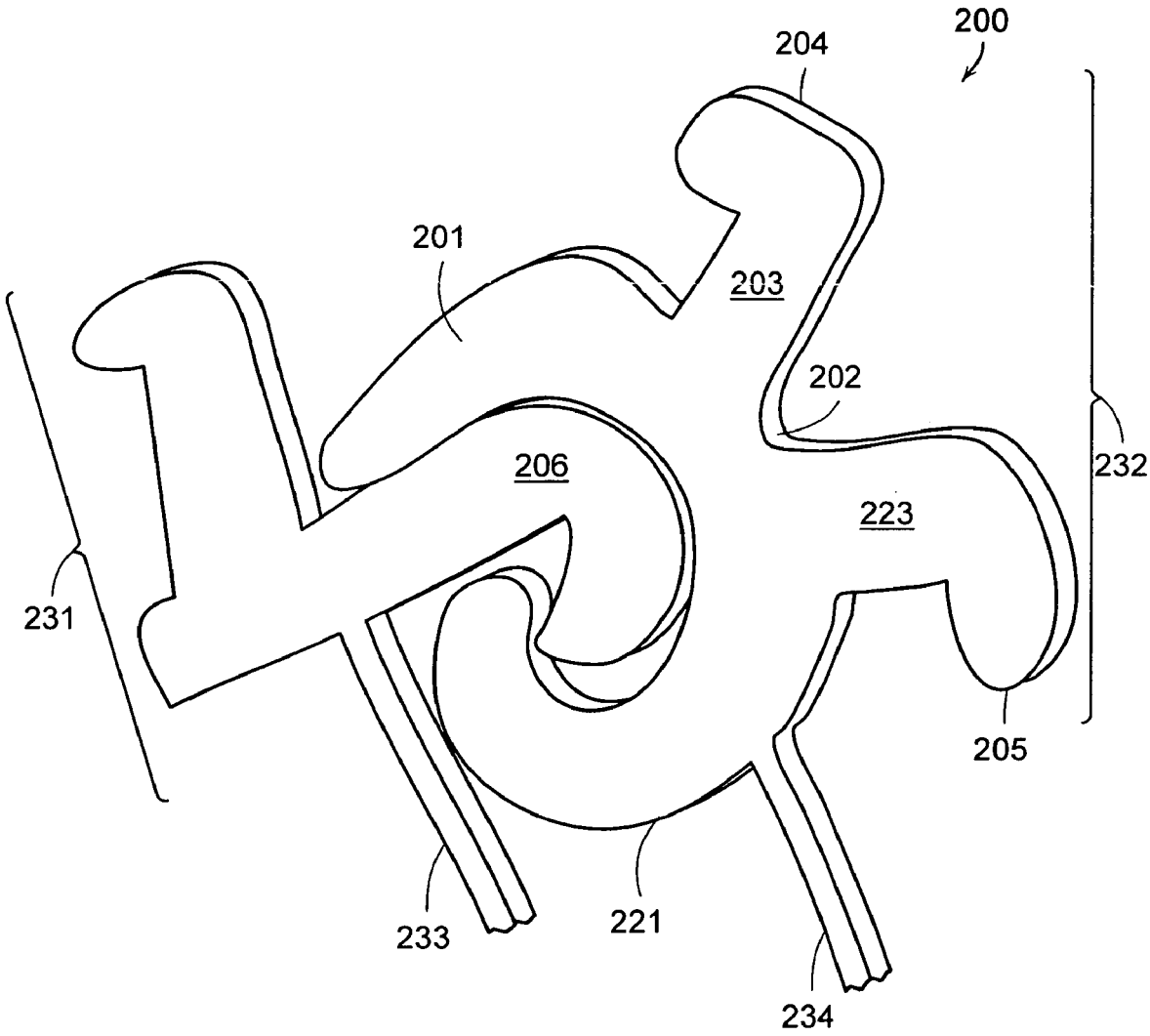
FIG. 2 is a cross section of a zipper profile according to another embodiment of the invention.

FIG. 2 is a cross section of a zipper profile which may be part of a thermoplastic bag upon which the end-clips of the present invention may be used. (A more complete description of the zipper profile of FIGS. 2–6 and its manufacture may by found in U.S. Pat. No. 6,439,771 which is hereby incorporated herein by reference.) The zipper profile of FIG. 2, including male and female elements and associated fins, is an example of the "profile track" described and claimed herein. However, other embodiments of a profile track are equally within the scope of the invention herein. A female element 200 has a pair of jaws 201 and 221 that move with respect to one another about a fulcrum region 202. Arms 203 and 223 are coupled to a corresponding one of the pair of jaws 201 and 221 at the fulcrum region 202. The arms 203 and 223 may each have an end 204 and 205 opposite from the fulcrum region 202 that is shaped for engagement with a slider, in a manner discussed with respect to the figures below. A male element 206 may be captured when the jaws 201 and 221 are in a closed position and released when the jaws are in an open position. Each of these elements 200 and 206 can be understood as having a profile portion, 231 and 232 respectively, for engagement and disengagement, as well as a fin portion, 233 and 234 respectively, for attachment, for example, to walls of a suitable enclosure. We sometimes refer to an element with its associated profile portion as a "profile strip".

Figure 3:
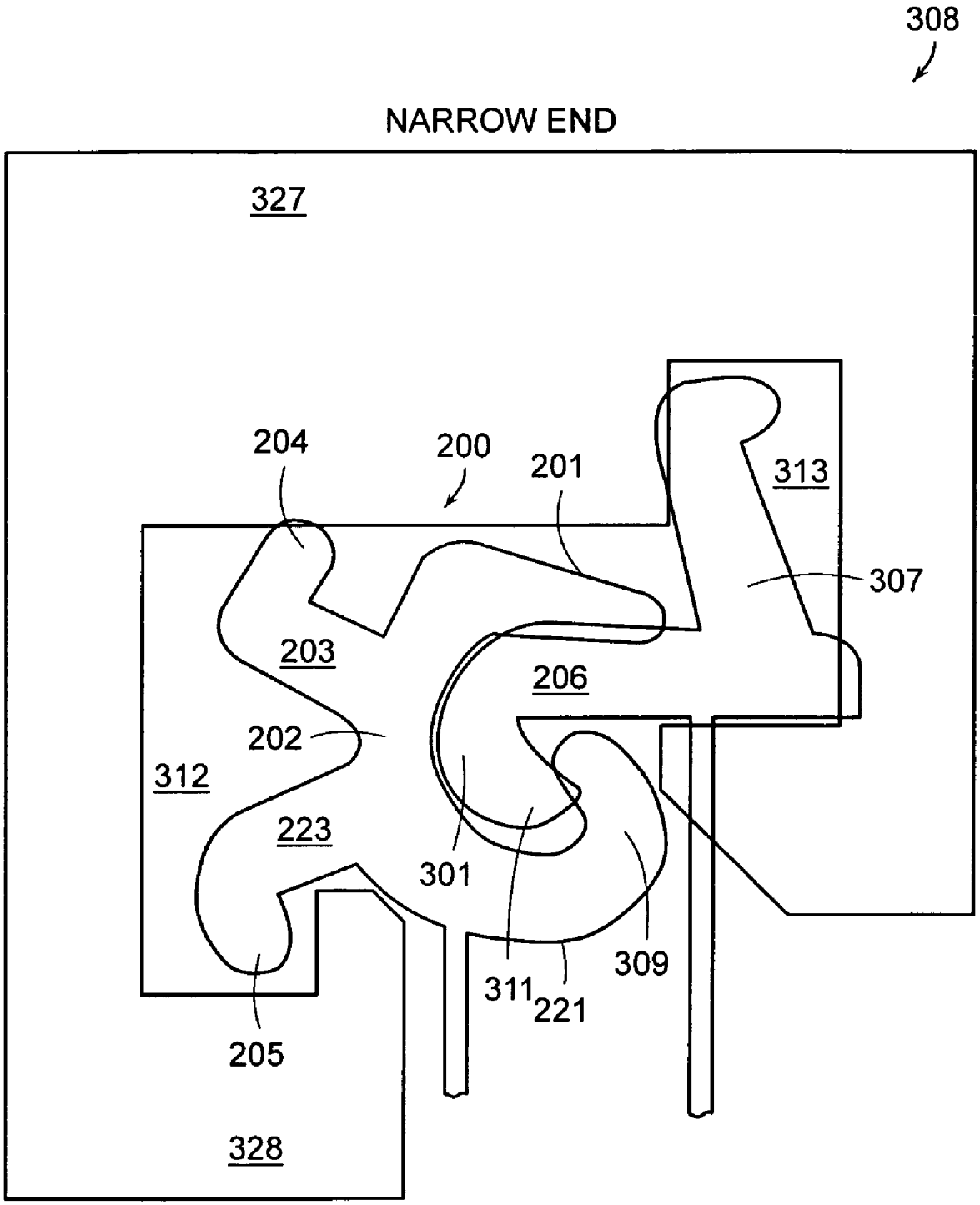
FIG. 3 is a diagrammatic cross sectional view of the embodiment of FIG. 2 used with a slider and taken through the narrow end of the slider.
Figure 4:
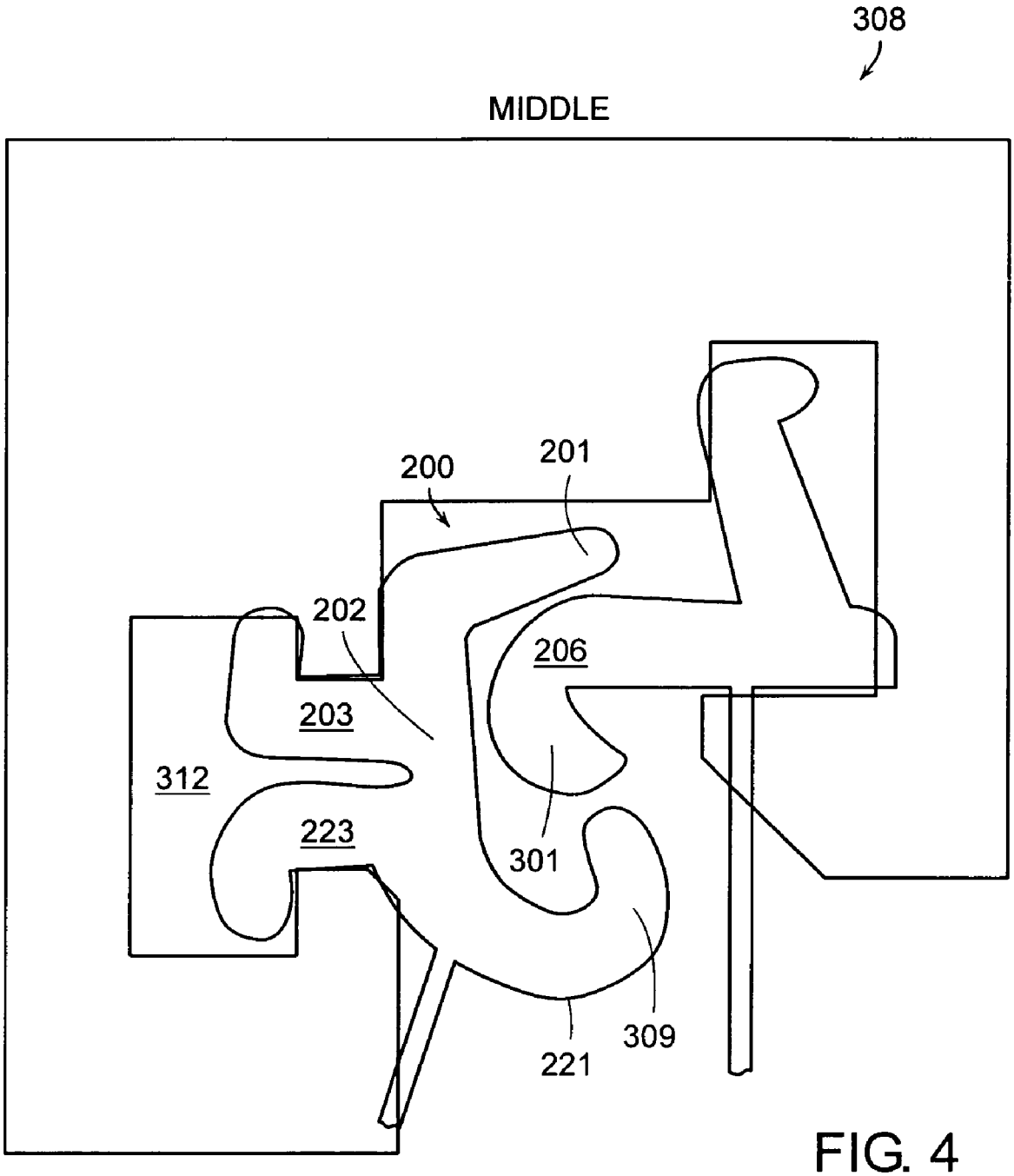
FIG. 4 is a diagrammatic cross sectional view of the embodiment of FIG. 3 taken through the middle of the slider.
Figure 5:
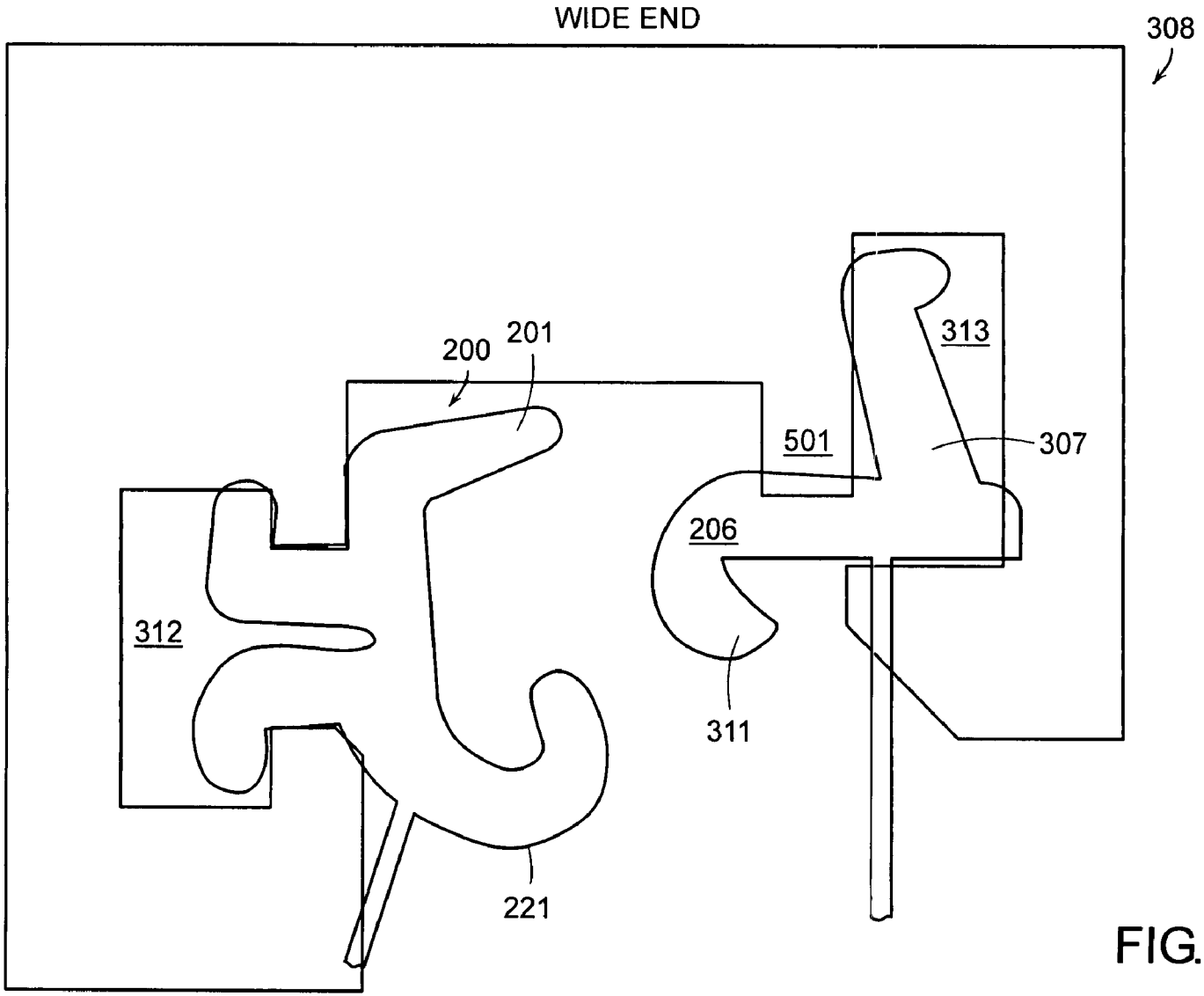
FIG. 5 is a diagrammatic cross sectional view of the embodiment of FIG. 3 taken through the wide end of the slider.

FIGS. 3–5 are sectional views showing the embodiment of FIG. 2 used with a slider according to one embodiment of the present invention. FIG. 3 is a diagrammatic cross sectional view of an embodiment taken through a narrow end of a slider. FIG. 4 is a diagrammatic cross sectional view of the embodiment of FIG. 3 taken through the middle of the slider, and FIG. 5 is a diagrammatic cross sectional view of the embodiment of FIG. 3 taken through a wide end of the slider. (We sometimes refer to the narrow end of the slider as the "trailing end" and the wide end as the "leading end".) A female element 200 of a first profile strip has a pair of jaws 201 and 221 that move with respect to one another about a fulcrum region 202. Each of a pair of arms 203 and 223 is coupled to a corresponding one of the pair of jaws 201 and 221 at the fulcrum region 202. The arms 203 and 223 each have an end 204 and 205, opposite from the fulcrum region 202 that is shaped for engagement with a slider 308. A male element 206 on a second profile strip includes an end region 307 for engagement with the slider 308. One of the jaws 221 of the female element 200 includes a first hook 309 and the male element 206 includes a tip 301 having a second hook 311. As will be shown in further detail below, in this embodiment, the arms 203 and 223, acting through the fulcrum region 202, are squeezed together to open the jaws 201 and 221 in a manner akin to squeezing the ends of a spring-loaded clothespin to open the clothespin.

The slider 308 has a cross section including a first channel 312 for capturing the ends 204 and 205 of the arms 203 and 223, and a second channel 313 for capturing the end region 307 of the male element 206. The channels 312 and 313 experience a change in separation along a longitudinal axis. There is no change between the trailing end of the slider in FIG. 3 and the middle in FIG. 4. Nevertheless, as the slider 308 moves relative to a point in the profile, so that the point has shifted from the trailing end to the middle—that is the slider is moved in the direction of the trailing end—the jaws have been caused to open, but the male element remains inside them. The jaws are caused to open because the first channel 312 decreases progressively in width between the trailing end in FIG. 3 and the middle in FIG. 4; the decreased width causes the arms 203 and 223 to be forced together, thereby opening jaws 201 and 221. In coordination with the operation of the jaws, once the jaws have been caused to be open at the middle of the slider, the separation between the channels 312 and 313 increases progressively from the middle of the slider to the leading end shown in FIG. 5. In this way, motion of the slider 308 in the direction of the trailing end pulls the male element 206 clear from the ends of the arms 203 and 223, while the jaws 201 and 221 are held in an open position. Consequently, the male element 206 is pulled away from the female element 200. Of course, the use of the term "middle" in relation to the slider is relative. The precise location for transitions between no change and progressive change in separation between channels 312 and 313 is a matter of design choice, and similarly the location for transition between no change and progressive change in width of channel 312 is a matter of design choice. Moreover these transition locations need not be in precisely the same place.

In this embodiment, the cross section of the slider 308 has a top 327 and a bottom 328. The first and second channels 312 and 313 are disposed in the cross section so that they are vertically offset from one another.

FIG. 3 shows that the first hook 309 and the second hook 311 are engaged when the jaws 201 and 221 are in a closed position at the narrow end of the slider 308. At the narrow end of the slider 308, the channels 312 and 313 are relatively close together. Consequently, the female element 200 and the male element 206 are pushed toward one another. The first hook 309 cradles the tip 301, and the hook 311 of the male element interlocks with the first hook 309 to ensure a tight seal. When the narrow end of the slider of FIG. 3 has passed over the length of the profile strips, the strips have been fastened to one another. Motion of the slider in the opposite direction has the effect of unfastening the strips, since the process described above is reversible.

FIG. 4 is a diagrammatic cross sectional view of the embodiment of FIG. 3 taken through the middle of the slider. This figure shows that as the slider 308 begins to move over the profile strips in the direction of the trailing end, the width of the first channel 312 has been diminished, so as to pinch together the arms 203 and 223 of the female element 200. The arms 203 and 223 are displaced about the fulcrum region 202, and the jaws 201 and 221 open to disengage the first hook 309 from the second hook 301.

FIG. 5 is a diagrammatic cross sectional view of the embodiment of FIG. 3 taken through the wide end of the slider. This figure shows that at a wide end of the slider 308, the jaws 201 and 221 of the female element 200 are in an open position, and the distance between the channels 312 and 313 of the slider 308 is at a maximum. The male element 206 and the female element 200 are completely separated, and the male element 206 is wholly released from the jaws 201 and 221. A projection 501 provides a restriction at the opening of channel 313 to prevent angular motion of the tip 311 of the male element 206 relative to the end region 307. In this way, the tip 311 is constrained by the projection 501 from moving toward the end region 307, and remains in position so that it can easily re-enter the jaws 201 and 221 of the female element 200 when the slider is moved in the direction of its leading end.

Figure 6:
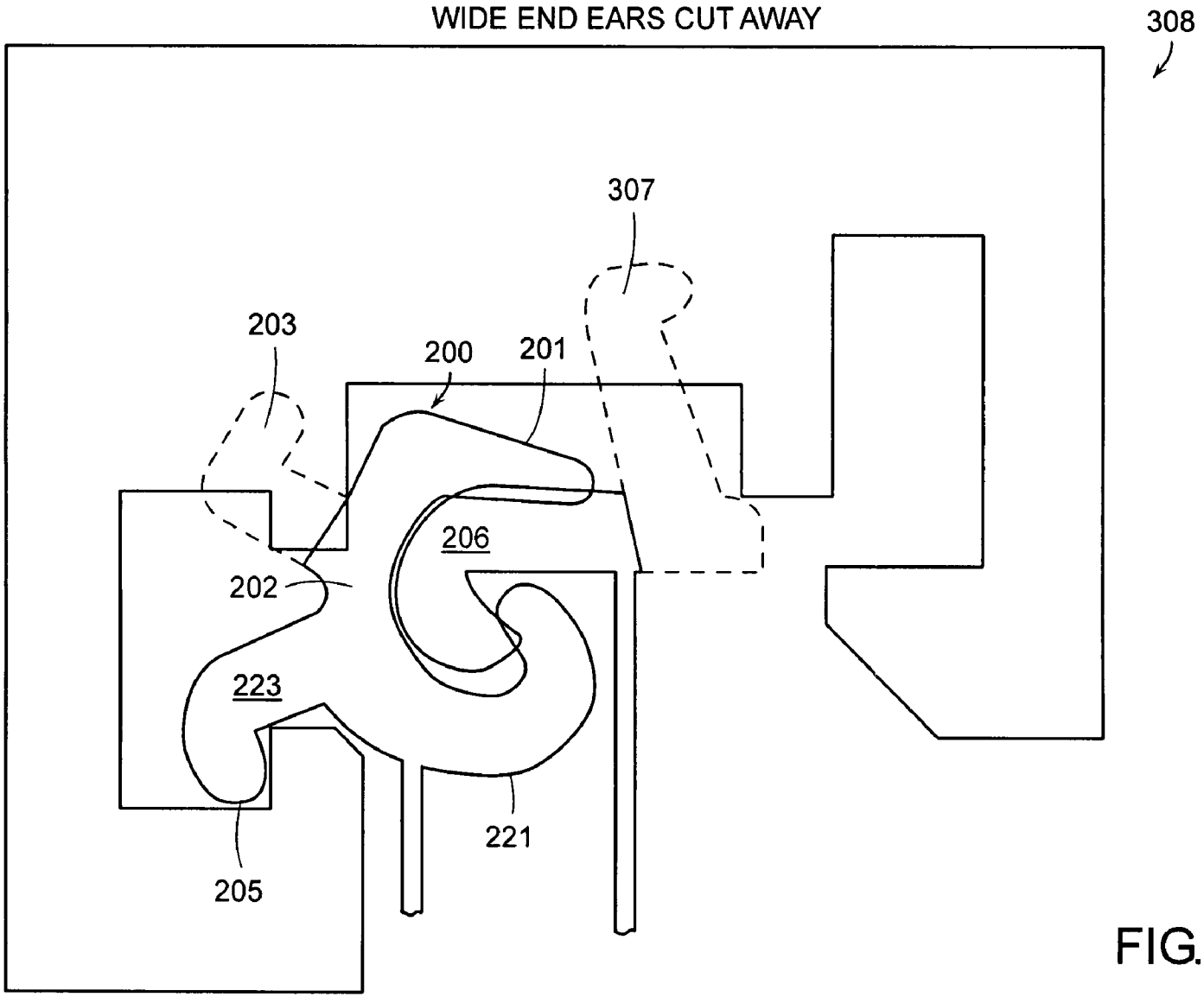
FIG. 6 is a diagrammatic cross sectional view of the embodiment of FIG. 3 showing modification of the profile in the rest region.

FIG. 6 is a diagrammatic cross sectional view of the embodiment of FIG. 3 showing modification of the profile in a rest region. The rest region may be formed near a longitudinal end of the first profile strip 310, and it is this end that is illustrated in cross section in FIG. 6. The rest region prevents leakage by providing a place for the slider 308 to rest when the zipper is closed. In the rest region, the female element 200 has one of its arms 203 (or both arms 203 and 223) truncated, so that when the slider 308 is positioned in the rest region, the slider will not cause the arms 203 and 223 to experience displacement about the fulcrum region 202, and the jaws 201 and 221 therefore assume the closed position.

Preferably, the end portion 307 of the male element is also truncated. Since the portion of the profile that is within this part of the slider 308 (here, the portion of the profile within the wide end of the slider) is incomplete—in that at least one of the pair of arms is absent and the male end portion 307 is also preferably absent—the slider 308 is not able to open the jaws 201 and 221 or pull apart the male element 206 from the female element 200. Consequently, the male element 206 and female element 200 remain engaged. It should be noted that the length of arm 203 (or arms 203 and 223) cut away or left out of the first profile strip is preferably less than the length of the slider 308 so that the entire profile is engaged in just one end of the slider, (here, the narrow end of the slider 308). In this way the profile stays threaded within the slider 308 so that when the slider 308 is drawn in the direction of the trailing end to separate the male and female elements, the entire profile moves into the full length of the slider 308, opening the profile. Further, when both arms 203 and 233 are truncated, the truncated portion of the profile may provide a place to attach the end clips 701 as described below.

FIG. 7 is a perspective view showing use of two of the end-clips of FIG. 1 situated on a profile track in a process for forming one or more bags in accordance with a further embodiment of the invention. The process illustrated in FIG. 7 may be used to create a succession of bags. The figure illustrates activities associated with, among other things, defining sides of adjacent bags. The profile track may be associated with first and second side panels of the thermoplastic bag or first and second fins of the profile track. The association may be made by affixing the side panels or fins to the profile track as part of the manufacturing process or the side panels or fins may be co-extruded with the profile track. In accordance with this embodiment, the arms 203 and 223 of the female profile of the profile track described above are cut to form an indented portion 703 which, for example, is approximately ¼" inch in length. The indented portion is here shown situated at a location where two adjacent bags may be cut apart during the manufacturing process. The indented portion 703 may be of a length great enough so as to provide a rest region for a slider (wherein the profile is also cut away as described above). In accordance with a related embodiment, instead of a single extended indented portion, there may be provided a first indented portion for the end stop and a second indented portion for a rest region for the slider.

One or more clips 701 may be inserted over the profile track 700 on one or both sides of the indented portion 703. A protrusion 708 on the short leg 704 of the clip engages a recess 705 on the female side 712 of the profile track 700 so that the clip 701 snaps over the zipper profiles. The clip 701 stays in place because of the resilience of the plastic and/or because one side of the clip is affixed to the profile panel or fin. If two clips are inserted on either side of the indented portion, a seal bar on the bag making machine can cut the profile track 700, fins 733 and 734, and film (or panel) 743 and 744 in the space between the clips to form two bags.

The long leg 706 of the clip is on the far side of the profile track 700 in the embodiment of FIG. 7. Ultrasonic tooling may be used to squeeze the long leg 706 against the profile track fin 733, causing it to fuse to the fin 733 just below the track. FIG. 8 is a graphical illustration showing the end-clips of FIG. 7 sealed to the profile track. The ultrasonic tooling may be shaped such that it simultaneously smashes the profile track 700 between the clips 701, which allows the seal bar to make the cut-off, thus forming two bags.

We have just described an embodiment relating to clip insertion. We now address more generally embodiments for the manufacture of bags. The profile track 700 is cut to form a laterally indented portion 703 on the profile track 700 and a slider, such as slider 308, is inserted onto the track 700. The slider is either inserted such that it is spaced a predetermined distance from the indented portion or the slider may be moved away from the indented portion 703 following insertion onto the track. After the slider is inserted on the profile track 700, the fins 733 and 734 and film 743 and 744 may be pre-sealed. Alternatively, profile track 700, the fins 733 and 734 and film 743 and 744 may be pre-sealed prior to inserting the slider on the profile track. The pre-seal may be accomplished by using heat, ultrasonic tooling, or any other method known in the art. The clips 701 are inserted or snapped over the profile track 700 and then ultrasonically (or in some other manner) sealed to the profile track. Each clip 701 may include an inward facing ridge 707 on one leg, and sealing may be accomplished by sealing only the ridge 707 to the corresponding panel. The profile track 700 adjacent each clip 701 is smashed during the sealing process. Note that one or more clips 701 can be inserted onto the profile track 700 and remain in place while the product moves to a next work station in which case the profile track is smashed between the clips, as is described in more detail below.

In accordance with a further embodiment of the invention, a plurality of bags may be sequentially formed during the manufacturing process using a plurality of work stations. The work stations may comprise a first work station whereat the indented portion is formed, a second work station whereat slider insertion occurs, a third work station whereat clips are inserted, a fourth work station whereat each clip is inserted onto the profile track and each clip (or a portion of each clip) is sealed to the profile track, and a fifth work station whereat a seal bar may separate adjacent bags. In accordance with this embodiment, each of the plurality of bags will be provided with an end-stop on a forward portion of its profile track as well as an end-stop on a rear portion of its profile track such that a slider associated with each bag cannot slide off the profile track when the bag is being closed or being opened. A first indented portion is formed along a length of profile track (which may include fins or panels as described above) in the first work station. The length of profile track is then advanced such that the first indented portion is at the second work station and a first slider is inserted onto the profile track via the first indented portion. The first slider is inserted and moved away from the first indented portion (either manually or via a machine) while a second indented portion is being formed along the profile track at the first work station. The distance between the first indented portion and the second indented portion may define the desired width of the bags formed.

The profile track is advanced again such that the first indented portion is at the third work station and the second indented portion is at the second work station. A first two clips are inserted on either side of the first indented portion at the third work station. While the first two clips are being inserted on either side of the first indented portion, a second slider is being inserted via the second indented portion at the second work station and a third indented portion is being formed on the profile track at a distance away from the second indented portion at the first work station.

The profile track is again advanced such that the first indented portion is at the fourth work station where a leg of each of the first two clips are sealed to profile track. As noted above, the first indented portion may be smashed as the first two clips are sealed. Further, as the first two clips are being sealed, a second two clips are being inserted on either side of the second indented portion at the third work station, a third slider is being inserted via the third indented portion at the second work station and a fourth indented portion is being formed a distance from the third indented portion at the first work station.

The profile track is advanced once more such that the first indented portion is at the fifth work station where a seal bar cuts the profile track at the first indented portion between the first two clips. Meanwhile, a leg of each of the second two clips is being sealed to the profile track at the fourth work station, a third two clips are being inserted on either side of the third indented portion at the third work station, a fourth slider is being inserted via the fourth indented portion at the second work station and a fifth indented portion is being formed a distance from the fourth indented portion at the first work station.

In accordance with the process described above, each pair of clips subsequent to the first two clips provides an end clip for a forward portion of the profile track of one bag and a rear portion of the profile track of the next bag. The forward-most of the first two clips is scrapped.

In the embodiments described above, the clips 701 are hooked over the female side 712, where the protrusion 708 on the clip is engaged in the recess 705 on the female track. Alternative track designs may be shaped differently, so that the actual wrapping or engagement could be different from what we have described here and more suitable for the specific track involved. Further, each clip 701 may be reversed such that it hooks over the male side 713, the long leg 706 of the clip is on the female side 712, and the sealing is below the female profile. The sealing may be to any location on the track 700 or the fins 733 and 734 (or panels 743 and 744), not just to the fin 733 as described here. The sealing could be done on the short leg 704 instead of the long leg 706. Further, both legs 704 and 706 of the clip 701 could be the same length. In addition, the indented portion may have a greater length, such as ⅞", and the clips can be placed partially or completely within the indented portion.

The end clips 701 can be colored as appropriate, for example, to match the color of the slider. Further, the clips 701 can be molded or made by profile extrusion, sliced off to length, which is much less expensive than injection molding as required by other types of end clips.

It should be understood that various changes and modifications to the preferred embodiments described above will also be apparent to those skilled in the art. Modifications can be made without departing from the spirit and scope of the invention and without diminishing its attendant advantages.

What is claimed is:

1. A method for making a continuous stream of resealable slider bags from a length of profile track, the profile track associated with a first side panel and a second side panel, the method comprising:

creating a laterally indented portion on the profile track at intervals along the track;

inserting a slider onto the profile track at each indented portion and moving each of the inserted sliders to locations away from the indented portion;

causing two clips, each having first and second legs, to straddle the profile track proximate to the indented portion, the first leg of each clip being proximate to the first side panel and the second leg of each clip being proximate to the second side panel, one of the legs of each clip having an inward-facing protrusion for engaging a corresponding recess on the panel proximate thereto, such that each clip resists vertical motion on the profile track; and sealing the other of the legs of each clip to the panel proximate thereto.

2. A method according to claim 1, wherein each clip is substantially J-shaped.

3. A method according to claim 1, wherein sealing the leg of each clip to the panel proximate thereto includes ultrasonically sealing the leg of each clip to the panel.

4. A method according to claim 3, wherein ultrasonically sealing the leg of each clip to the panel proximate thereto includes smashing a portion of the profile track adjacent each clip.

5. A method according to claim 1, wherein one of the legs of each clip is shorter than the other of the legs of the clip.

6. A method according to claim 1, wherein sealing each leg of the clip to the panel proximate thereto includes sealing an inward facing ridge on the leg to the panel proximate thereto.

7. A method according to claim 1, wherein the intervals are spaced apart a length equal to the width of a bag.

8. A method for making at least one resealable slider bag from a length of profile track, the profile track associated with a first side panel and a second side panel, the method comprising:

creating a laterally indented portion on the profile track;

inserting a slider onto the profile track at the indented portion and moving the slider to a location away from the indented portion;

causing a clip having first and second legs to straddle the profile track proximate to the indented portion, the first leg of the clip being proximate to the first side panel and the second leg of the clip being proximate to the second side panel, one of the legs of the clip having an inward-facing protrusion for engaging a corresponding area on the panel proximate thereto, such that the clip resists vertical motion on the profile track; and ultrasonically sealing the other of the legs of the clip to the panel proximate thereto.

9. A method according to claim 8, wherein ultrasonically sealing the leg of the clip to the panel proximate thereto includes smashing a portion of the profile track adjacent the clip.

10. A method for making at least one resealable slider bag from a length of profile track, the profile track associated with a first side panel and a second side panel, the method comprising:

creating a laterally indented portion on the profile track;

inserting a slider onto the profile track at the indented portion and moving the slider to a location away from the indented portion;

causing a clip having first and second legs to straddle the profile track proximate to the indented portion, the first leg of the clip being proximate to the first side panel and the second leg of the clip being proximate to the second side panel, one of the legs of the clip having an inward-facing protrusion for engaging a corresponding area on the panel proximate thereto, such that the clip resists vertical motion on the profile track; and sealing the other of the legs of the clip to the panel proximate thereto, wherein one of the legs of the clip is shorter than the other of the legs of the clip.

* * * * *